US008157676B2

(12) United States Patent
Cobham

(10) Patent No.: US 8,157,676 B2
(45) Date of Patent: Apr. 17, 2012

(54) GOALIE TRAINING DEVICE

(76) Inventor: Andrew Cobham, Ottawa (CA)

( * ) Notice: Subject to any disclaimer, the term of this patent is extended or adjusted under 35 U.S.C. 154(b) by 0 days.

(21) Appl. No.: 12/492,365

(22) Filed: Jun. 26, 2009

(65) Prior Publication Data

US 2010/0331123 A1 Dec. 30, 2010

(51) Int. Cl.
*A63B 69/00* (2006.01)

(52) U.S. Cl. ..... 473/446; 473/422

(58) Field of Classification Search ..... 473/422, 473/446, 417, 419, 420; D21/715, 716
See application file for complete search history.

(56) References Cited

U.S. PATENT DOCUMENTS

| | | | | | |
|---|---|---|---|---|---|
| 213,203 | A | * | 3/1879 | Jewell | 188/32 |
| D193,758 | S | * | 10/1962 | Blommel, Jr. | D20/41 |
| D204,727 | S | * | 5/1966 | Diehl | D20/10 |
| 3,517,905 | A | * | 6/1970 | Nestegard | 248/469 |
| 3,856,298 | A | | 12/1974 | Frantti | |
| 3,870,309 | A | * | 3/1975 | Tessier | 473/587 |
| 4,049,267 | A | * | 9/1977 | Forrest | 473/419 |
| 4,348,827 | A | * | 9/1982 | Brinker | 40/606.19 |
| D301,906 | S | * | 6/1989 | Coolen | D21/710 |
| 5,226,821 | A | | 7/1993 | Murphy et al. | |
| D338,250 | S | * | 8/1993 | Tvedt | D21/716 |
| 5,238,243 | A | * | 8/1993 | Grispi | 473/446 |
| 5,362,045 | A | | 11/1994 | Hammett et al. | |
| 5,429,359 | A | * | 7/1995 | Timperman et al. | 473/471 |
| 5,580,048 | A | | 12/1996 | Mullen et al. | |
| 5,690,565 | A | * | 11/1997 | Swanson | 473/417 |
| D401,987 | S | * | 12/1998 | Amburgey et al. | D21/715 |
| 5,863,268 | A | * | 1/1999 | Birch | 473/563 |
| 6,328,664 | B1 | | 12/2001 | Hammett | |
| 6,475,108 | B1 | * | 11/2002 | Sarenana et al. | 473/420 |
| 2004/0221500 | A1 | * | 11/2004 | Schaak et al. | 40/745 |
| 2005/0192125 | A1 | * | 9/2005 | Valliquette | 473/446 |
| 2006/0116224 | A1 | * | 6/2006 | Andersen | 473/446 |
| 2006/0154752 | A1 | * | 7/2006 | Hutton | 473/446 |
| 2006/0252581 | A1 | * | 11/2006 | Wegryn | 473/446 |

OTHER PUBLICATIONS

Office Action issued by the Canadian Intellectual Property Office, dated Jun. 16, 2009, for co-pending Canadian Application No. 2,626,999.

Office Action issued by the Canadian Intellectual Property Office, dated Aug. 25, 2011, for co-pending Canadian Application No. 2,626,999.

* cited by examiner

*Primary Examiner* — Mitra Aryanpour
(74) *Attorney, Agent, or Firm* — Greer, Burns & Crain, Ltd.

(57) ABSTRACT

A device for training hockey goaltenders including a base having an ice engaging surface to reduce sliding on the ice, a plurality of side panels arranged around a perimeter of the base and secured directly or indirectly to the base, each side panel having an outer surface adapted to deflect a hockey puck directed at it, and wherein a first side panel outer surface is made of a material that is different from a second side panel outer surface.

19 Claims, 5 Drawing Sheets

GOALIE TRAINING DEVICE

BACKGROUND

The present invention relates to the field of athletic training equipment. Specifically, the present invention provides a device to assist ice hockey goaltender training.

A goaltender, or goalie, in hockey has the task of keeping pucks from entering the net during a hockey game. In order to become proficient at this task, they must practice many hours with teammates and coaches. One of the skills that is practised most intensely is reacting to deflection. In the game of hockey, a deflection occurs when a shot or pass strikes a player or a stick. The puck will change direction, sometimes only slightly, and sometimes drastically. The goalie must learn to react to the deflection, and quickly determine the puck's new path, so he or she can prevent the puck from entering the net. Moreover, often the goalie's view of the puck will be screened by players in front of the goalie.

To practice reacting to deflections, a variety of drills have been developed, usually involving having a first player positioned some distance away from the net shooting the puck toward the net, and a second player positioned close to the net, possibly in front of the goalie to obscure his vision or screen the shots, attempting to deflect the pucks as they are shot with his hockey stick. This is a very effective drill, teaching valuable game skills. However, it involves having two players other than the goalie participate. Moreover, since the player close to the goalie, providing the screen and the deflection, is in the way of the shots taken by the other player, he or she is exposed to potential injury on each shot.

A simpler drill that has been developed involves placing a board or other hard object on the ice near the net, and having the shooter bounce pucks off the board, toward the goalie. This drill is effective but the goalie is able to predict very quickly how the puck will usually bounce off a given barrier, so it lacks the spontaneity of a live player deflecting the puck. Furthermore, the shots will not be screened. Also, the barrier placed by the coach will often move along the ice surface, so it must be repositioned frequently.

SUMMARY OF THE INVENTION

The object of the present invention, then, is to provide a device for goalie training that can be used to deflect pucks shot at a net.

In a preferred embodiment, the device of the present invention will provide more than one deflecting surface, and each deflecting surface provides a deflection with different characteristics simulating different deflecting that can occur in game condition.

In a further preferred embodiment, the device is operable to change deflecting surfaces either by remote control or randomly.

In another preferred embodiment, the device is provided with a screening panel, to simulate a screen set up by a player being positioned in front of or beside the goalie.

In a broad aspect, then, the present invention relates to a device for training hockey player comprising: a) a base having an ice engaging surface to minimize sliding on the ice; b) a plurality of side panels arranged around the perimeter of the base and secured directly or indirectly to the base, each side panel having an outer surface shaped to deflect a hockey puck directed at it.

BRIEF DESCRIPTION OF THE SEVERAL VIEWS OF THE DRAWINGS

In drawings that illustrate the present invention by way of example.

DETAILED DESCRIPTION OF THE PREFERRED EMBODIMENTS

Figure 1:
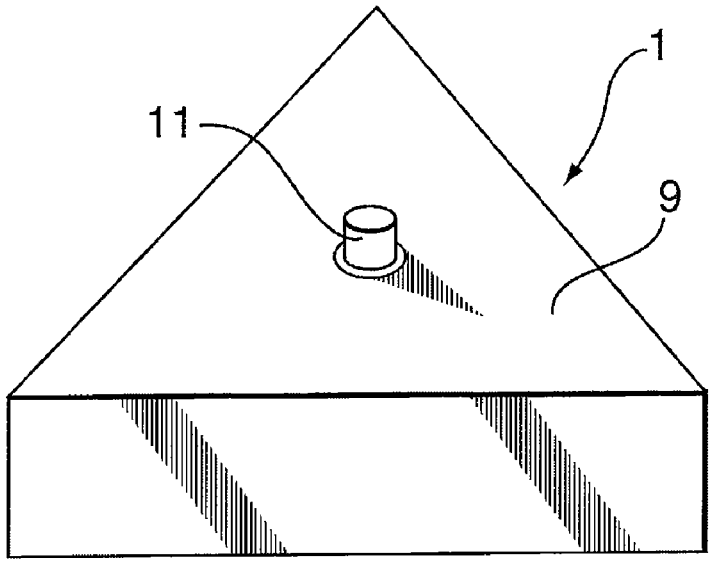
FIG. 1 is a perspective view of a first embodiment of the present invention.
Figure 2:
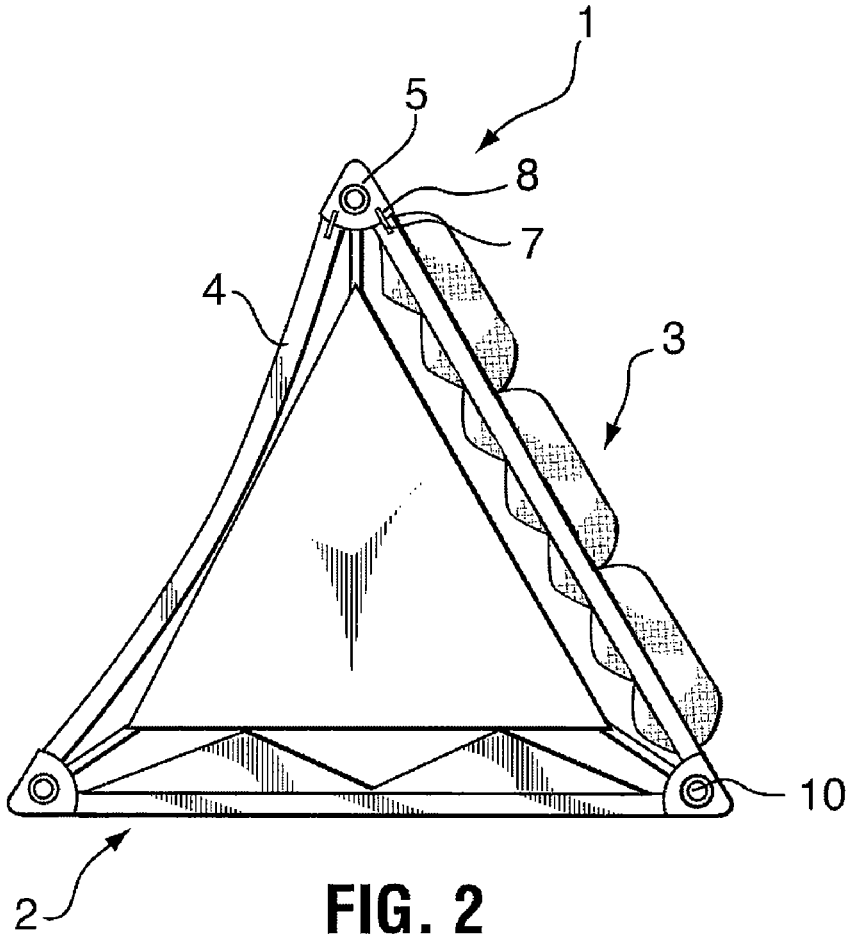
FIG. 2 is a top view of the embodiment of FIG. 1, but without a cover.
Figure 3:
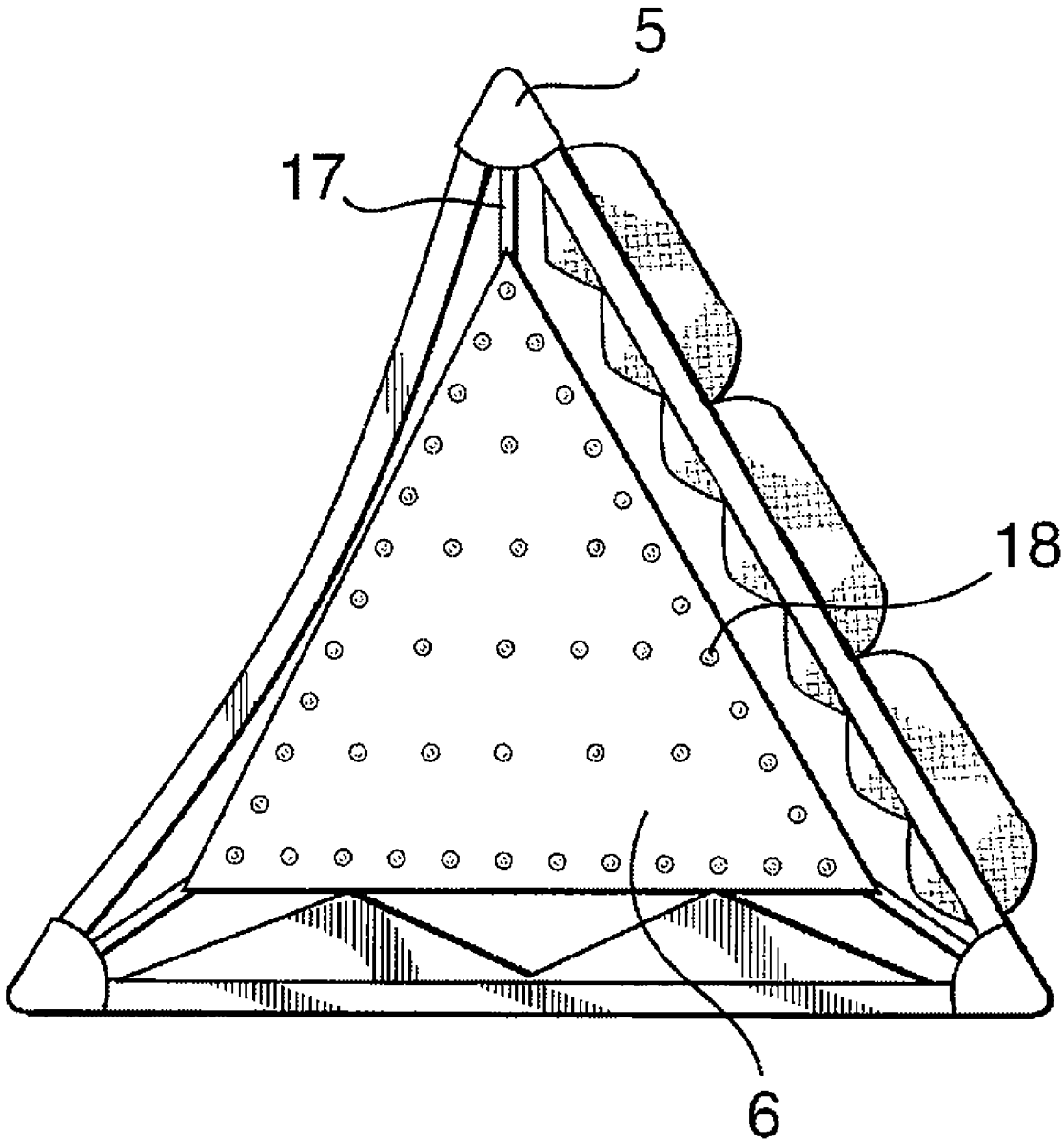
FIG. 3 is a bottom view of the embodiment of FIG. 1.

Referring now to FIGS. 1-3, in its most basic form, the present invention provides a deflection trainer 1 that has a number of deflecting surfaces 2, 3, 4 around its perimeter. Three surfaces are shown, forming a triangle, but other confirmations will be a matter of choice to one skilled in the art, in view of the essential features of the present invention.

The deflecting surfaces may include a flat hard vertical surface 2 to simulate a stick or blade; a rounded padded surface 3 to simulate a player's body, and a tilted, slightly curved surface 4, to simulate the shooting surface of a stick. The surfaces 2, 3, 4 may be made of wood, fibreglass reinforced wood, high density polyethylene, carbon composite, or any other appropriate material. Padded surfaces should not be too soft, and should be covered with fabric to simulate hockey clothing, so that the puck will come off the padding in a manner similar to the way it comes off a body.

Moreover, each surface should, if possible, provide appropriate visual cues. For instance, a padded surface should be coloured like a hockey sweater, and a surface simulating a stick blade should have the taped appearance of a stick blade, to teach the goalie to associate bounce characteristics with visual cues.

At each corner of the device, a resilient corner piece 5 may be provided. Corner pieces 5 are firmly connected to the base 6 of the device, for instance by screws or bolts, and are provided with means to mount and de-mount deflection surfaces chosen form a variety of deflection surfaces, such as those discussed above. Other deflection surfaces may include:

i) a bumpy surface, to simulate a skate boot ii) a sharply angled flat or concave surface, to create high, upwardly moving deflections iii) an elastic web, to create a deflection of variable speed, relative to the initial shot Other appropriate surfaces will be obvious to those skilled in the art.

While the deflecting sides, eg 2,3,4, may be permanently attached to the corners 5 and base 6, it is preferable that means are provided at each end of the sides to attach the sides to the corners 5 so that the sides can be easily detached. Such means may be a vertical profile 7 at the end of the sides keyed to a vertical slot 8 as shown in one of the corners 5 in FIG. 1, or it may simply be alignable bolt holes in the corners and sides, to permit the sides to be securely bolted to the corners, yet easily removed. Furthermore, the sides may be two-sided, so that they can be taken off and reversed easily, to provide a different deflecting surface. An example of a two sided side piece would be a flat piece that is padded on one side, and not padded on the other, with the two sides provided with appropriate visual indicia or cues. It will also be understood that the corners 5 may be eliminated, and the ends of the sides joined to each other.

Figure 4:
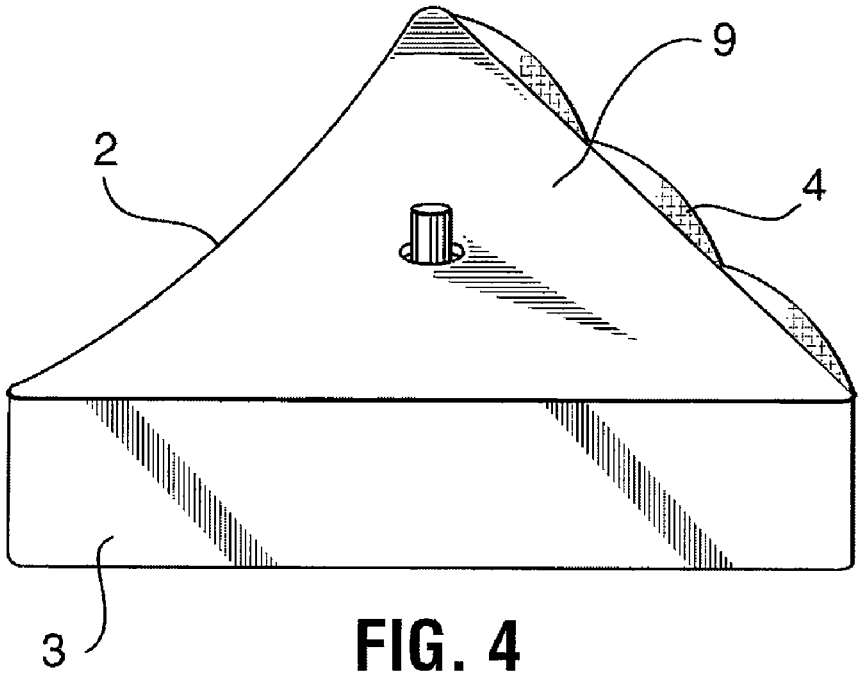
FIG. 4 is a perspective view of a second embodiment of the present invention.
Figure 7:
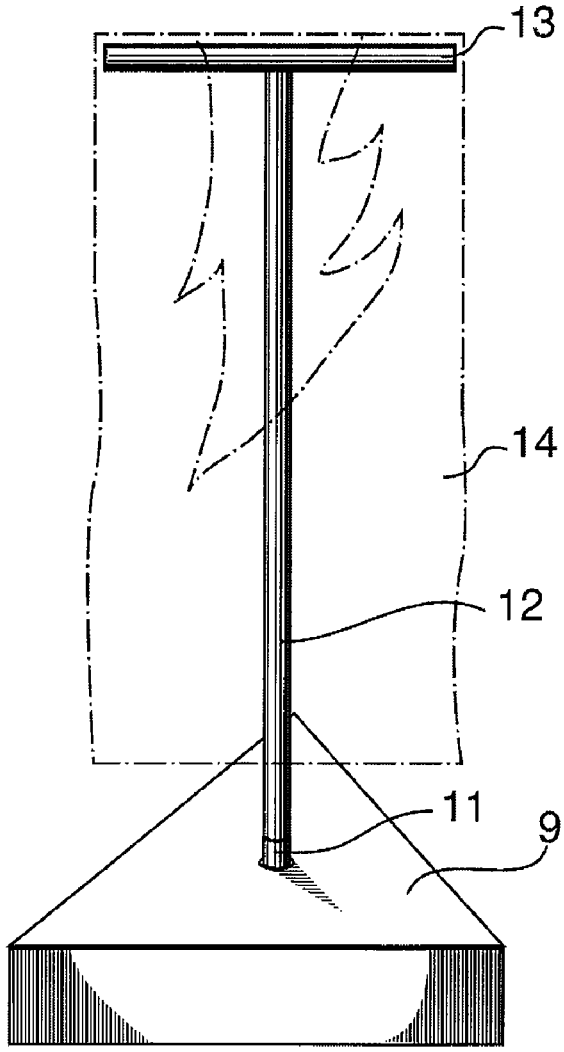
FIG. 7 is a perspective view of the first embodiment, showing the screening panel of the present invention.

As shown in FIG. 4, a cover 9 may be provided. Preferably, the cover 9 will attach to the corners by easily detachable means, such as magnets 10 or detents or VELCRO® hook and loop fastener material. As shown in FIG. 7, the cover is preferably provided with mounting means such as a centrally located collar 11 to mount a screening device (see FIG. 7). The screening device may be fabricated from a vertical mast 12*a* on which horizontally mounted a second mast 12*b*, from which is hung a screen 14 of fabric of sufficiently large size to obscure a goalie's view of a shooter. Preferably, the fabric will extend down to the cover 9, and will be coloured to simulate a hockey sweater, so as to provide an appropriate visual reference. The screen is also an effective shooting target for training the goalie in its own right. That is, the shooter may aim the puck anywhere at the screen 14, and since it hangs loosely from the second mast 12*b*, the puck will not be stopped but will emerge from the fabric, to be stopped by the goalie.

Referring to FIG. 3, the base 6 of the device, to which the corners 5 are attached for instance by arms 17, is provided with a lower surface that is textured to grip the ice, or provided with projections 18, spikes or the like to grip the ice. Preferably, a plurality of small projections are utilized, to hold the device firmly on the ice, without unduly damaging the ice surface.

Figure 5:
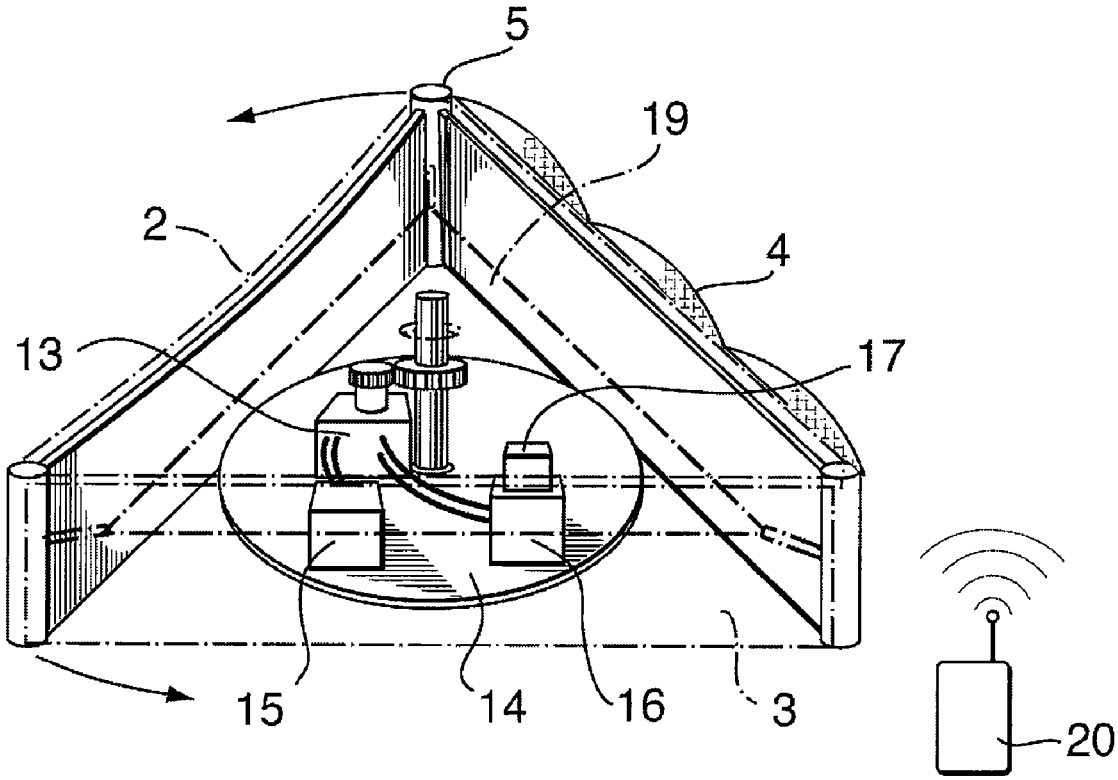
FIG. 5 is a cutaway view of the second embodiment.

Referring to FIG. 5, a cut away of another version of the present invention is shown. It is provided with a motor 13 centrally positioned in a two part base. The two part base comprises a lower portion 14 to engage the ice surface. The lower portion is connected to and supports the motor 13. Also connected to the motor by reduction gearing is the upper portion 19 of the base, connected to the corners 5 to which sides 2, 3, 4 and cover 9 are attached. The motor is provided with an energy source, such as a battery 15, and a control circuit 16. Control circuit 16 may be provided with a receiver 17 to receive control signals from a remote control device 20 that may be activated by a coach or player. Activation of the remote control causes the control circuit to actuate the motor, to turn the upper portion of the base, thereby to rotate the entire device 1, to present a new deflecting surface to the shooter. Alternatively, control circuit 16 may be provided with means to cause random rotation of the device. In either case rotation may be incremental, presenting each side in a correct position after rotation, rather than continuous. However, in the case of remote control, continuous rotation, that can be stopped at any point, may be used, if desired.

Figure 6:
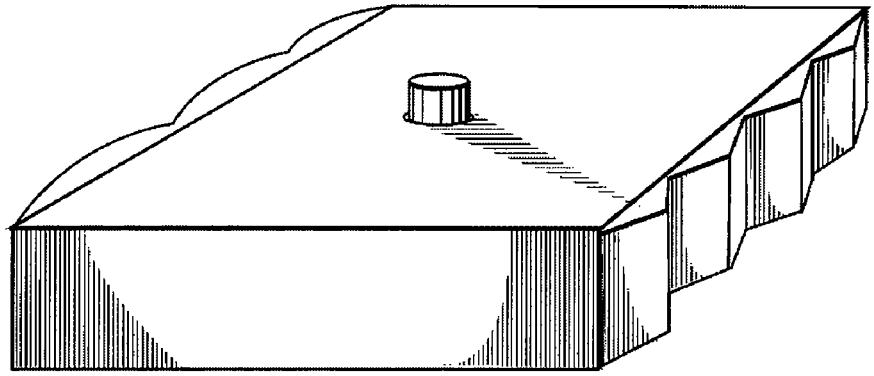
FIG. 6 is a perspective view of a third embodiment of the present invention.

An alternate embodiment of the present invention is shown in FIG. 6, to illustrate that the present invention may be another shape, such as a square.

An example of a goaltender training device 1 according to the present invention is shown in FIGS. 8, 9, 10 and 11.

The device 1 shown in FIGS. 8-11 is provided with three deflecting surfaces namely a flat hard vertical surface 2, a concave vertical surface 21 and a convex vertical surface 22. Each surface 2, 21, 22 is made from a shaped length of wood 23, to which a hard plastic 20 sheet, in this instance a polycarbonate sheet 24 has been fastened with a plurality of screws 25.

Wood pieces 23 are fastened to triangular frame members 26 that is mounted on a base plate 6. Durable corner pieces 5, in this case made from wood that has been covered with sheet steel are provided in the corners between shaped wood pieces 23.

In the embodiment shown in FIGS. 8-11, the collar 11 is mounted on the base plate 6 instead of cover 9. Accordingly, a hole 27 is bored in cover 9, through which vertical mast 12 may be inserted for mounting in collar 11.

Figure 8:
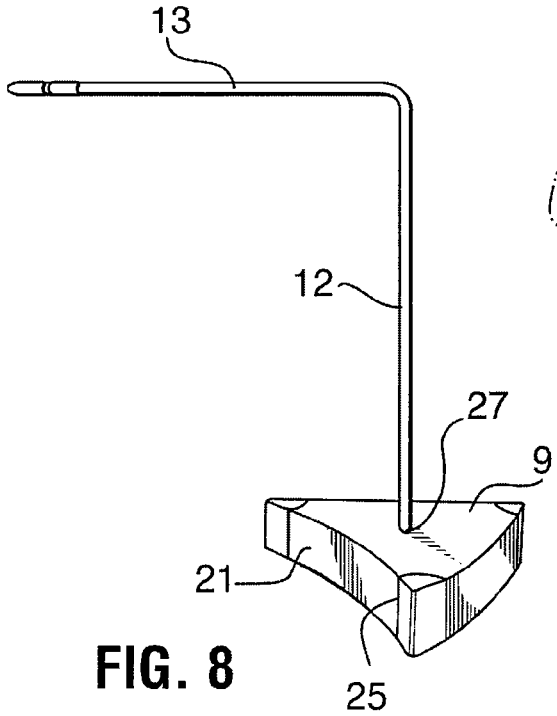
FIG. 8 is a front perspective view of a goaltender training device manufactured in accordance with the present invention.
Figure 9:
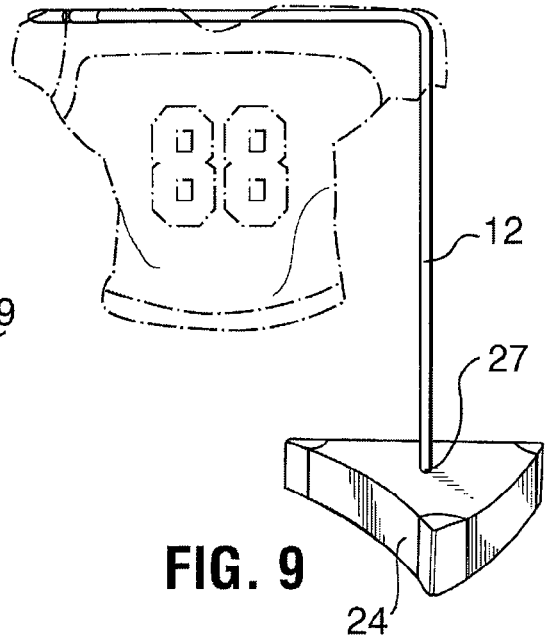
FIG. 9 is the same view as FIG. 8, but with a hockey sweater mounted on the mast thereof.

As shown in FIGS. 8 and 9, the mast assembly, consisting of vertical mast 12*a* and horizontal mast 12*b* may be L-shaped, and a sweater may be hung directly on horizontal mast 12*b*, which may then be positioned as desired by a coach to simulate a player screening a goaltender.

Figure 10:
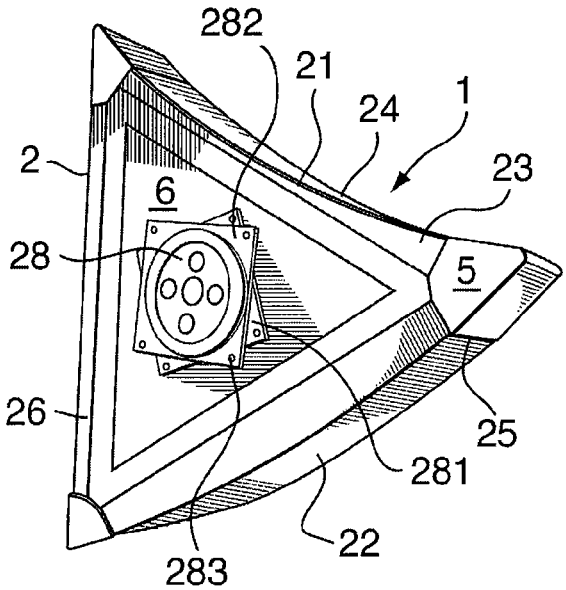
FIG. 10 is an underside view of the device shown in FIG. 8.
Figure 11:
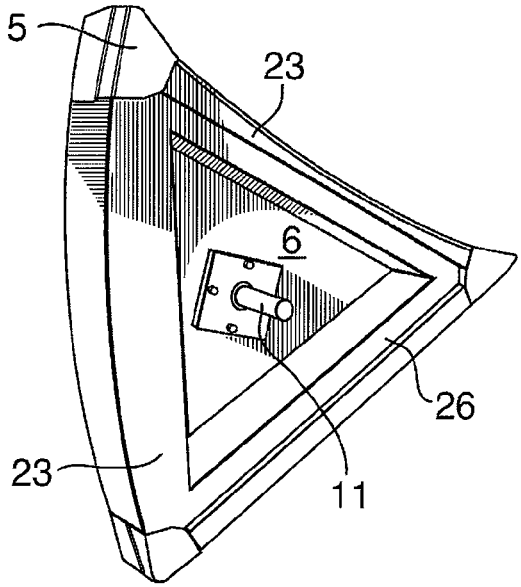
FIG. 11 is a top view of the device shown in FIG. 8, with the cover removed.

Referring to FIG. 10, a preferred base design is shown. Base plate 6 is fastened to frame members, countersunk slightly to accommodate the depth of turntable 28 that is attached to the centre of base plate 6. Turntable 28 has an upper piece 281 that can be screwed onto base plate 6, and lower piece 282 that is provided with spike element 283 to hold the device 1 firmly to the ice, without unduly damaging the ice. Turntable 28 is adjusted to permit the device to be rotated, but not to spin freely. That is, it is acceptable and even desirable that a hard shot will cause the device to rotate slightly, changing the deflection angle between shots, for more realistic training.

It will be understood that numerous variants in materials, shapes, and deflecting surfaces are possible without departing from the spirit of the invention.

The invention claimed is:

1. A device for training hockey goaltenders comprising:

a base having an ice engaging surface to reduce sliding on the ice;

at least three vertically oriented side panels arranged around a perimeter of the base, each said side panel having a rigid outer surface configured for deflecting a hockey puck directed at said corresponding side panel, and wherein a first side panel outer surface is made of a material that is different from a second side panel outer surface for simulating hockey game conditions; and at least three corners, each configured for releasably connecting adjacent ends of a corresponding pair of said side panels.

2. The device as claimed in claim 1 wherein said first side panel outer surface is convex.

3. The device as claimed in claim 1, wherein said first side panel outer surface is concave.

4. The device as claimed in claim 1, wherein each said corner extends up from said base.

5. The device as claimed in claim 4, wherein said side panels are removable.

6. The device as claimed in claim 5, further comprising a cover panel extending to the perimeter of said device.

7. The device as claimed in claim 1, wherein said device is provided with a vertically extending screen.

8. The device as claimed in claim 7, wherein said screen comprises a mast from which may be hung a vertical piece of fabric material, and wherein said screen substantially obstructs visibility through said screen.

9. The device as claimed in claim 1, wherein a plane defined by said outer surface of each said corresponding side panel is generally perpendicular to a plane defining said ice engaging surface.

10. The device as claimed in claim 1, wherein said first side panel outer surface and said second side panel outer surface are each made of one of a wood, fibreglass reinforced wood, high density polyethylene, or carbon composite material, and wherein said first side panel outer surface has a different shape than said second side panel outer surface.

11. The device of claim 8, wherein only one edge of said vertically extending screen is mounted to said mast.

12. The device of claim 7, wherein said vertically extending screen has a height and a width wherein said height is greater than said width.

13. A device for training hockey goaltenders comprising:

a base having an ice engaging surface to reduce sliding on the ice;

at least three vertically oriented side panels arranged around a perimeter of the base, each said side panel having a hard rigid outer surface configured for deflecting a hockey puck directed at said corresponding side panel;

wherein a first side panel outer surface is made of a material that is different from a second side panel outer surface for simulating hockey game conditions;

at least three corners, each configured for releasable connecting adjacent ends of a corresponding pair of said side panels, and wherein each said side panel is configured for releasably corresponding adjacent pair of said corners; a cover attached to an upper edge of each side panel; and a collar disposed on said cover and configured for mounting a screening device.

14. The device of claim 13, wherein a plane defining an upper surface of said cover is generally parallel to a plane defining said ice engaging surface.

15. The device of claim 13, wherein said cover is generally triangularly-shaped, and wherein said collar is generally centrally located on an upper surface of said cover.

16. The device of claim 13, comprising four side panels, wherein said cover is generally square-shaped, and wherein said collar is generally centrally located on an upper surface of said cover.

17. The device of claim 13, further comprising a screening device mounted on said collar, wherein said screening device includes a mast mounted to said collar and a screen hung from said mast, and wherein said screening device substantially obstructs visibility though said screen.

18. The device of claim 13, further comprising a screening device mounted on said collar, wherein said screening device includes a vertically-oriented mast mounted to said collar, a horizontally-oriented mast affixed to said vertically-oriented mast, and a screen hung from said horizontally-oriented mast, and wherein said screening device substantially obstructs visibility though said screen.

19. A device for training hockey goaltenders, comprising:

a base having an ice engaging surface to reduce sliding on the ice;

a plurality of side panels arranged around a perimeter of the base and secured directly or indirectly to the base, each side panel having an outer surface configured for deflecting a hockey puck directed at said corresponding side panel;

wherein a first side panel outer surface is made of a material that is different from a second side panel outer surface for simulating hockey game conditions;

a plurality of corners, each configured for releasable, connecting adjacent ends of a corresponding pair of said side panels;

a chamber defined by said base; and a motor disposed in said chamber and configured for rotating said base about a vertical axis perpendicular to a plane defined by said ice engaging surface, upon receiving control signals from a remote control device.

* * * * *